United States Patent [19]

Wood

[11] 4,126,249

[45] Nov. 21, 1978

[54] COLLAPSIBLE TUBES

[75] Inventor: George D. Wood, Feltham, England

[73] Assignee: Lever Brothers Company, New York, N.Y.

[21] Appl. No.: 765,489

[22] Filed: Feb. 4, 1977

[51] Int. Cl.[2] ..... B65D 35/08
[52] U.S. Cl. ..... 222/92; D9/194
[58] Field of Search ..... 222/92; 229/8; 215/100.5; D9/194, 211, 215

[56] References Cited

U.S. PATENT DOCUMENTS

| | | | |
|---|---|---|---|
| D. 212,150 | 9/1968 | Caliman et al. | D9/194 |
| 2,792,149 | 5/1957 | Lutz | D9/194 X |

*Primary Examiner*—Joseph F. Peters, Jr.
*Assistant Examiner*—Norman L. Stack, Jr.

[57] ABSTRACT

A collapsible tube has a body portion of plastics material one end of which is flattened to a seal and the other end has a head for receiving a closure cap, longitudinal and curved crease lines in the body portion minimizing suck back and facilitating dispensing the contents with maximum initial volume.

4 Claims, 7 Drawing Figures

Fig.5.
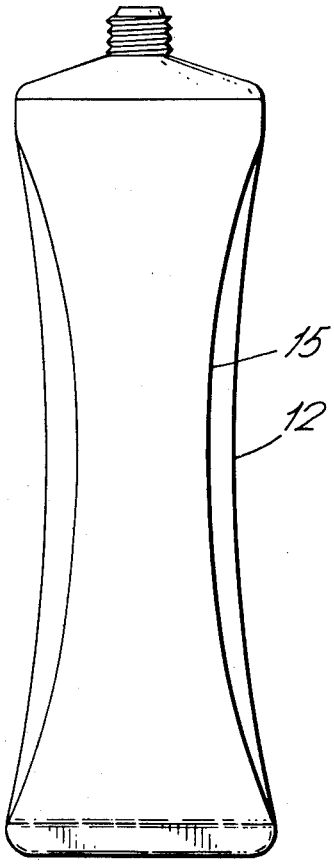
Fig.6.
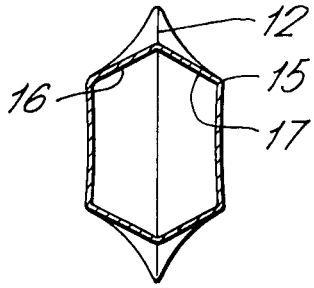
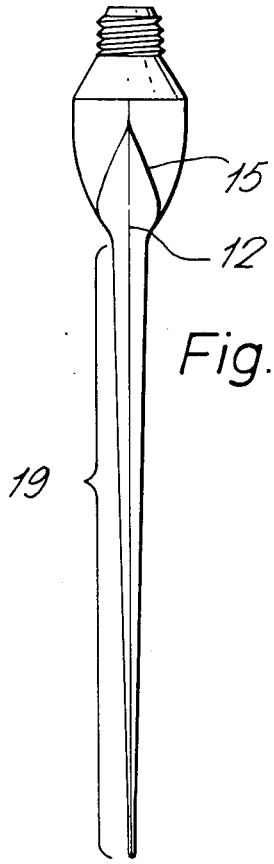
Fig.7.

COLLAPSIBLE TUBES

This invention relates to improvements in or relating to collapsible tubes for dispensing toothpaste, salves, creams and the like and particularly to a collapsible tube of flexible plastics material.

The replacement of the conventional tube of lead, tin and other ductile materials by a tube of flexible plastics material has been inhibited by the problem that after a quantity of the contained material has been squeezed out the material at the tube outlet is sucked back into the tube as the squeezing pressure on the tube body is released. This so-called "suck-back" problem gives rise to difficulties both to the user and for the contained material itself due to the entry of air into the tube as it is emptied.

Conventionally collapsible tubes are sealed at one end with a transverse flat seal and are provided at the other end with a circular head having the circular portion secured within the body of the tube and an annular shoulder portion tapering inwardly away from the tube body to an outlet which can be closed, for example, by a threaded cap. The diameter of the circular portion is of course one of the parameters determining the volume of the tube but this circular portion also makes it difficult to expel the last of the contained material, particularly when the body is of flexible plastics material and cannot be rolled up as can a tube of ductile material.

It has been proposed to provide the tube with an elliptical head, that is a head in which the skirt portion which is secured to the tube body is elliptical. This minimises the problem of expelling the last of the contained material. Such an elliptical head when used with a body of flexible plastics material gives however a reduced volume for a given area of the flexible plastics material as compared to the use of a circular head because of the generally flattened cross-section of the tube body. It is of course possible to fill such a tube having an elliptical head under pressure to achieve a greater volume of contained material but this is unacceptable to the user since the contained material would be expelled by the overpressure on opening the tube.

It is therefore an object of the present invention to provide a collapsible tube of flexible plastics material which minimises both the problem of suck-back and that of squeezing out the entire contained material without unduly reducing the contained volume.

According to the present invention there is provided a collapsible tube having a tubular body portion of flexible plastics material closed at one end by a transverse flat seam and provided at the other end with a head having a skirt portion secured within the body portion, the skirt portion having a major axis aligned with the transverse flat seam and a minor axis transverse thereto, a longitudinal preformed crease line extending from each end of the major axis to the respective ends of the transverse flat seam and a curved preformed crease line on both sides of each of the longitudinal crease lines, the ends of the curved crease lines joining with respective longitudinal crease lines and the curved crease lines defining at the location where they are spaced most distant from their respective longitudinal creases a rectangular transverse cross-section of the filled body having an area greater than the transverse cross-sectional area of the body at the head.

The curved crease lines in the tube according to the present invention enable the tube body to be gradually collapsed from the filled condition as the contained material is squeezed out. This is because the curved lines define a pre-determined filled shape of the body and when the body is squeezed from this shape towards the empty or flattened condition the shape of the body is determined by the longitudinal crease lines and the shape and size of the head.

In the filled condition the body portion of the tube takes up a shape defined by the curved crease lines, the body wall between each of the two curved lines which join one of the longitudinal crease lines when viewed in a transverse plane being a substantially straight line. As the contained material is reduced this substantially straight line becomes a "V" shaped line having one of the longitudinal creases at its apex, the longitudinal crease lines at each side of the tube progressively moving outwards reducing the included angle of the "V" as the quantity of contained material reduces. The curved crease lines allow this flattening of the body to take place from the flat seam at the base of the tube progressively towards the head.

In that the head is not circular in cross-section where it fits the body portion squeezing out of the last of the contained material is facilitated since the free state of the empty tube is inherently more flattened that if the head was circular. Nevertheless the volume of the tube in the full condition, and in which the contained material is not subject to pressure from the tube tending to collapse, is increased for a given area of body material by reason that the body portion has a maximum cross-sectional area greater than that of the head.

The curved crease lines are preferably arranged symmetrically about the longitudinal crease lines and advantageously join the longitudinal crease lines at the intersection of the latter with the transverse flat seam at one end of the body and at the intersection with the innermost edge of the skirt portion of the head at the other end of the body.

In order that the tube has a maximum volume the maximum distance that the curved crease lines are spaced from the respective longitudinal crease lines is such that the maximum transverse cross-section is a square.

The invention will now be more particularly described with reference to the accompanying diagrammatic drawings in which FIG. 1 shows a front view of a collapsible tube in the fully filled condition;

FIG. 5 shows the tube of FIG. 1 in a partially empty condition;

FIG. 6 shows a cross-sectional elevation of the tube of FIG. 5 similar to FIG. 4; and FIG. 7 shows the side view of the tube of FIG. 1 almost empty.

Figure 1:
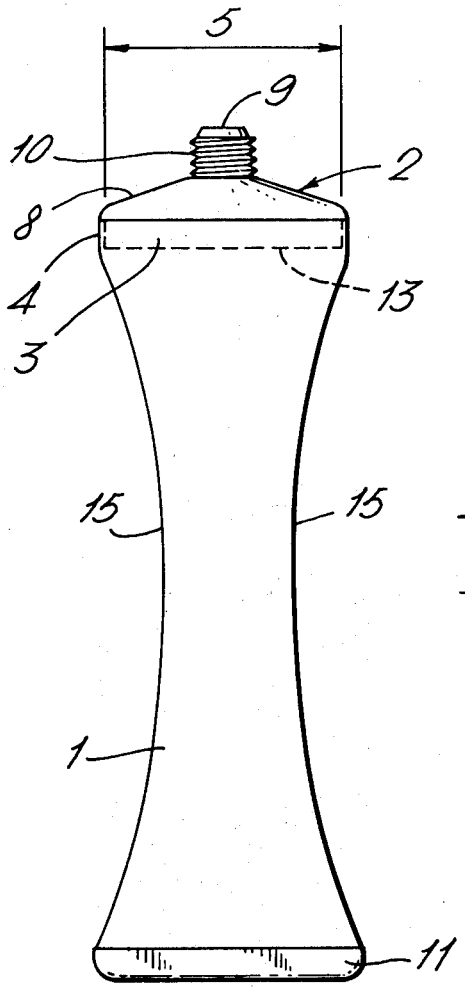
Figure 2:
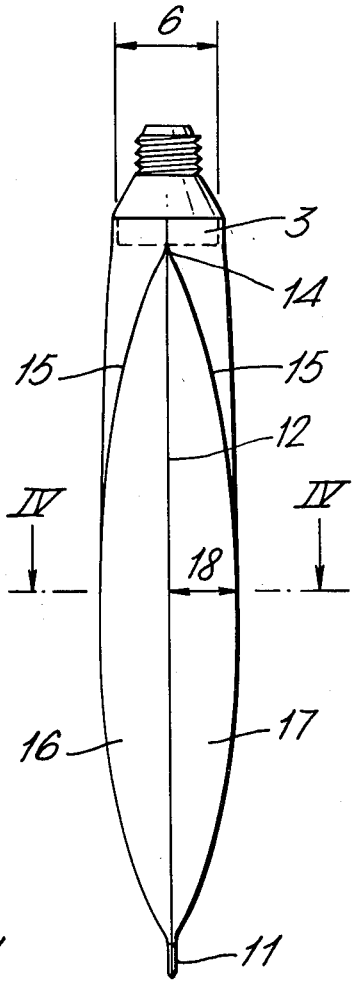
FIG. 2 shows a side view of the tube of FIG. 1.
Figure 3:
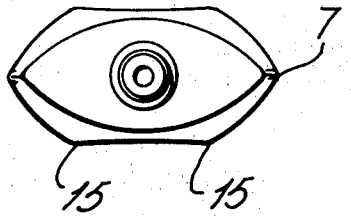
FIG. 3 shows a plan view from above of the tube of FIG. 1.

Referring to FIGS. 1 to 4 there is shown a collapsible tube having a body portion 1 of polypropylene film 300 microns thick and an injection moulded head 2 of plastics material. The head has a skirt portion 3 which is secured within the body portion 1, the body portion abutting with a shoulder 4 defining one end of the skirt. The skirt has an oblong shape having a major axis 5 and a minor axis 6 with a curved profile extending symmetrically about the major axis. The intersections of the curved profile with the major axis are substantially points at 7.

From the shoulder 4 the head has an inwardly sloping shoulder portion 8 terminating in an outlet 9 threaded at 10 to receive a closure cap (not shown). The length of the minor axis 6 of the skirt is determined primarily by the size of the outlet and the closure cap, the length of the minor axis being kept as small as practical.

The body portion is closed at the end opposite the head by a transverse flat seam 11 parallel with the major axis of the head. From each end of the flat seam longitudinal pre-formed crease lines 12 extend the length of the body portion to the ends 7 of the major axis of the head. From positions 14 just below the innermost edge 13 of the skirt portion of the head 4 curved preformed crease lines 15 extend from the longitudinal crease lines, two curved crease lines being associated with each longitudinal crease line. The curved crease lines 15 are symmetrical about their respective longitudinal crease lines and curve away from the longitudinal crease lines towards the mid point of the body length and then curve back to meet the intersection of the respective longitudinal crease lines with the transverse flat seam thereby defining with the longitudinal crease lines body side wall portions 16 and 17. The maximum distance 18 which the curved lines are spaced from the longitudinal crease lines lies substantially mid-way along the body and is greater than one half of the minor axis 6 of skirt 3 so that at the mid position of a filled tube the transverse cross-section as shown in FIG. 4 is a rectangle having an area greater that the area of the skirt.

Figure 4:
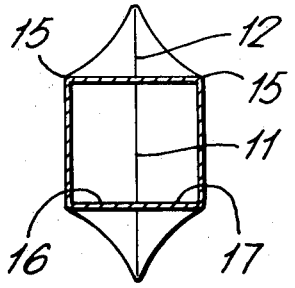
FIG. 4 shows a transverse cross-section along the line IV—IV of FIG. 2.

In the filled condition as shown in FIGS. 1 to 4 the shape of the body portion is determined by the curved crease lines 15. Side wall portions 16 and 17 between the two curved crease lines associated with one longitudinal crease line are substantially aligned with one another as shown in FIG. 4 and in this condition the tube is stable so that it can contain material without the contained material being under pressure.

As the tube is squeezed to expel the contained material the side wall portions 16 and 17 collapse outwardly to a "V" shape having the longitudinal crease line 12 at the apex of the "V" as shown in FIGS. 5 and 6. In this partially empty condition there is no tendency of the body to revert to the shape of a fully filled container. Moreover, after the side wall portions 17 and 18 together form a "V" shape the preformed crease lines tend to urge the body of the tube gently towards the flattened condition. This minimises any tendency towards "suck-back."

As the tube is further emptied the body takes up a shape shown in FIG. 7. The natural tendency of the tube when empty is to take up a tapered shape having its widest part determined by the minor axis of the head and tapering from the head towards the transverse flat seam. Thus in the extreme case that the minor axis of the head was nil the natural shape of the tube when empty would be flat with no contained colume. The minor axis of the head is therefore kept as small as possible and it has been found in practice that the natural stickiness of remaining traces of the contained material keep the body walls together in the empty part of the tube as shown at 19 in FIG. 7. This stickiness is sufficient to maintain material in the outlet and thus prevent air being sucked back into the tube, the remaining contained material staying at the top of the tube. The generally flattened transverse cross-sectional shape of the head allows substantially all the contained material to be squeezed out and generally assists in keeping the body of the tube in the flattened state to which it has been squeezed.

It will of course also be appreciated that because the sum of the maximum lengths 18 of the side wall portions 16 and 17 associated with one of the longitudinal crease lines is greater than the length of the minor axis of the head the volume of the tube in the stable filled condition is greater than if the curved lines were not present. The maximum volume of the tube is achieved when the maximum length 18 of each of the side wall portions 16 and 17 is equal to ⅛th of the transverse peripheral length of the body so that the cross-section of maximum area is a square.

Without the curved lines the tube would have only one stable shape, i.e. tapered from the head to the transverse flat seam similar to that of the tube of the present invention when empty. Such a tube could of course be filled under pressure with a greater volume of contained material but would result in a large amount of the material being expelled as soon as the closure cap was removed. When the contained material is only used in small quantities at any one time e.g. tooth paste, this is most undesirable.

The body portion of the tube can be made from a flat sheet of the flexible plastics material and the preformed crease lines formed by upsetting the material in any conventional manner. The sheet of material can then be folded along the two longitudinal crease lines and joined by a longitudinal seam (not shown) to form a tube.

Whilst the described embodiment of the invention has curved crease lines extending symmetrically substantially the entire length of the body portion of the tube it will be clear that other configurations of the curved crease lines can be adopted which provide a tube having a stable condition in the filled condition and having a volume in excess of the volume of a filled tube in the stable condition utilising the same area of material for the body portion but without the curved crease lines.

What is claimed is:

1. A collapsible tube comprising:

(a) a tubular body of flexible plastics material, said body having a longitudinal axis and including a closed end portion terminating in a flat seam extending traversely of said longitudinal axis;

(b) a head arranged adjacent to an opposite end portion of said body and having a reclosable opening through which any contents in said body are dispensible; and (c) a skirt interconnecting said head and body, said skirt having a major axis and a minor axis in mutually perpendicular relation, said skirt having a narrower side substantially parallel to said minor axis and a wider side substantially parallel to said major axis, said major axis extending in substantially parallel alignment with said flat seam, said body including a first pair of longitudinally extending preformed crease lines, one said crease line extending on each said narrower side of said body, said crease lines extending from either end of said flat seam longitudinally to said skirt, said body further including two additional pairs of longitudinally extending preformed crease lines, the crease lines of said two additional pairs being curved, one pair of curved crease lines extending along each said narrower side of said body, each pair of said curved crease lines extending from either end of said flat seam longitudinally to said skirt, the crease lines of each said additional pair of crease lines extending on either side of a respective one of the first said crease lines and intersecting one another as well as the respective one of the first said crease lines at each of the opposite ends of the latter said crease lines, said additional pairs of crease lines defining, at a location on said body where they are spaced most remote from their corresponding first said pair of crease lines, a transverse cross-section of rectangular form, in a filled-condition of said body, having a greater area than the transverse cross-sectional area of said body at said head.

2. A collapsible tube according to claim 1 in which the curved crease lines are arranged symmetrically about the longitudinal crease lines.

3. A collapsible tube according to claim 1 in which one end of the curved crease lines join the longitudinal crease lines at the intersection of the transverse flat seam therewith and the other end of the curved crease lines joins the longitudinal crease lines adjacent the intersection therewith of the innermost edge of the skirt portion of the head.

4. A collapsible tube according claim 1 in which the maximum distance that the curved crease lines are spaced from the respective longitudinal crease lines is such that the maximum transverse cross-section is a square.

* * * * *

UNITED STATES PATENT AND TRADEMARK OFFICE

CERTIFICATE OF CORRECTION

PATENT NO. : 4,126,249

DATED : November 21, 1978

INVENTOR(S) : George D. Wood

It is certified that error appears in the above-identified patent and that said Letters Patent are hereby corrected as shown below:

In the Title Page:

Below the filing date, add the following:

-- Foreign Application Priority Data
Feb. 17, 1976 United Kingdom 6177/76 --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*